United States Patent [19]

Dold, deceased

[11] 4,081,097

[45] Mar. 28, 1978

[54] SAFETY CLOSURE FOR BOTTLES

[75] Inventor: Siegfried Dold, deceased, late of Rheinberg, Germany, by Hildegard Dold, heir

[73] Assignee: Underberg Gesellschaft mit beschrankter Haftung, Rheinberg, Germany

[21] Appl. No.: 741,761

[22] Filed: Nov. 15, 1976

[30] Foreign Application Priority Data

Nov. 18, 1975 Germany ..... 2551708

[51] Int. Cl.[2] ..... B65D 41/34

[52] U.S. Cl. ..... 215/252

[58] Field of Search ..... 215/250, 252, 253; 220/265, 266, 276

[56] References Cited

U.S. PATENT DOCUMENTS

| | | | |
|---|---|---|---|
| 2,423,582 | 7/1947 | Coleman | 215/252 |
| 2,950,832 | 8/1960 | Brune | 215/252 |
| 3,504,818 | 4/1970 | Crisci | 215/252 |

*Primary Examiner*—Donald F. Norton

*Attorney, Agent, or Firm*—Martin A. Farber

[57] ABSTRACT

A safety closure for bottles with a thread on the neck and a bead arranged thereunder, including a screw cap and a safety ring fastened thereon with safety fracture stays. At least two teeth are arranged offset relative to one another by a circumferential angle on the neck of the bottle on the bead. At least two break-open pins which are offset relative one another by a circumferential angle are joined on the lower edge of the screw cap. The safety ring is provided with at least one safety breaking point.

15 Claims, 6 Drawing Figures

SAFETY CLOSURE FOR BOTTLES

The invention relates to a safety closure for bottles with a thread on the neck and a bead arranged thereunder, as well as a screw cap and a safety ring fastened thereon with safety fracture stays.

Safety closures of the above-mentioned type are generally known in various embodiment forms. They are made either of metal or plastic. In the embodiment form which is made of metal, the safety closure possesses a screw cap with a safety ring secured thereon by means of safety fracture stays, which either catches or engages under the threading or a bead or ridge on the neck of the bottle. During opening of the screw cap, the safety fracture webs are broken or clipped off, so that the safety ring remains hanging on the neck of the bottle. It always occurs again and again that the safety fracture stays are not formed weak enough so that a cutting off is not possible by turning the screw cap in the opening direction and a tool must be used as an aid for the destruction of the safety fracture stays. The safety ring which remains hanging on the neck of the bottle has there, where the safety fracture webs or stays have been cut off, very sharp edges or ridges, so that again and again injuries could occur to the lips by drinking from the opened bottle. Also when the safety ring breaks or ruptures open and remains hanging on the screw cap, there exists the danger of injury.

Embodiment forms of the known safety closures which are made of synthetic material also fundamentally have this injury danger. In both embodiment forms, those made of metal and those of plastic, the known safety closures have the serious disadvantage that an opening and subsequent originally true, and as faithful closing as the first time is possible without separation of the screw cap from the safety ring. For this it is merely necessary to somewhat widen, open out or stretch the safety ring and after the closing, again to press it on the neck of the bottle or the circumferential bead. Consequently also again and again an unauthorized opening occurs with bottles provided with a safety closure, which again is closed, after the contents have been partially removed, changed, or indeed contaminated.

Accordingly it is an object of the present invention, to provide a safety closure for bottles, which can be screwed on by machine or also by hand, and can easily and reliably be opened, without having parts which remain hanging on the neck of the bottle, and after opening for the first time cannot be closed again originally true or faithfully as the first time whereby on the other hand the function of the screw cap is completely preserved.

It is another object of the present invention to aid the solution of the above-mentioned task by providing a safety closure in which there are arranged at least two teeth or a plurality of teeth greater than two which are offset relative to one another by a circumferential or peripheral angle, the teeth being arranged on the neck of the bottle on the bead, and joined onto the lower edge of the screw cap there are arranged at least two burst- or break- open pin or a plurality of burst open pins greater than two which are offset relative one another by a circumferential angle, and the safety ring is provided with at least one safety breaking point area.

With one practical advantageous embodiment in accordance with the present invention, the teeth in the closing direction can be formed with a back sloping upwardly from the upper side of the bead, which can also further still be inclined from the outside toward the inside. In the direction of opening, to the contrary, the teeth advantageously have a face extending outwardly from the neck of the bottle tangentially or at an obtuse angle, which additionally still can be inclined from the base or foot to the back. On the outer periphery, the teeth can terminate or close flush or snug with the bead on the neck of the bottle.

If in accordance with the present invention the burst- or break-open pins are joined or connected on the lower edge of the screw cap, which pins are made of an elastic flexible material, then they can be bent about on the back of the teeth and guided on the neck of the bottle, until the screw cap is completely screwed on. Thereafter the break-open pins engage the neck of the bottle in the gaps or spaces of the teeth. The break- open pins can be changed or varied in their lengths. They must however be at least so long such that they project into the spaces between the teeth with the closed screw cap. During opening of the screw cap, the break-open pins are radially outwardly guided on the faces or fronts of the teeth against the there arranged safety ring until the latter bursts or breaks apart, under the arising radial pressure, at its safety breaking region and is torn off, also then partly from the safety fracture stays or webs connecting the screw cap therewith. Thereafter the safety ring can be torn off completely without difficulty from the remaining safety fracture stays.

The screw cap with the break-open pins and the safety ring can be advantageously injection molded from a thermoplastic synthetic material. It is also however basically possible to produce the screw cap with the burst- or break-open pins and the safety ring made of metal.

A safety closure formed in accordance with the present invention has the outstanding advantage that after opening for the first time it cannot be closed originally true and faithful as the first time, because the safety ring is destroyed in every case during the opening. A further advantage resides in that on the neck of the bottle no parts remain hanging and also during opening no parts of the closure can fall into the bottle. Injuries during drinking from the bottle are consequently avoided. A further advantage resides in that the safety closure formed in accordance with the present invention can be screwed on by machine, with mass bottling, yet still with an individual or single bottling it can be screwed on by hand.

Moreover there is an important advantage in accordance with the present invention, that the safety closure can be easily and reliably opened by hand without the need for the aid of a tool in individual cases. Also a tearing out or ripping away does not occur. In spite of these many advantages, the function of the screw cap is not impaired during opening and destruction of the safety ring. It is possible without anything more to repeatedly close the bottle after operation, whereby the engagement catching or locking of the break-open pins with the teeth on the bottle during each closing, prevents an unintentional release of the screw cap. A safety closure formed in accordance with the present invention however can be used with bottles of all orders of size.

With the above and other objects and advantages in view, the present invention will become more clearly understood in connection with the following detailed description of a preferred embodiment, when considered with the accompanying drawings, of which:

Figure 1:
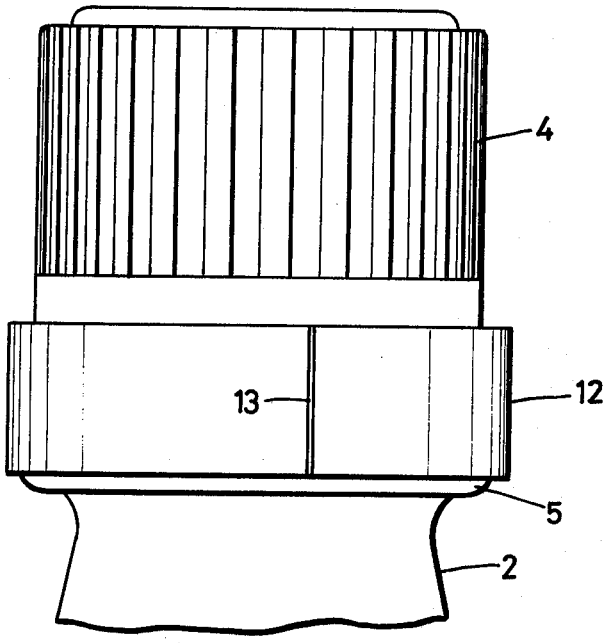
FIG. 1 is a broken away elevational view of a upper part of a bottle with a screwed on safety closure.
Figure 2:
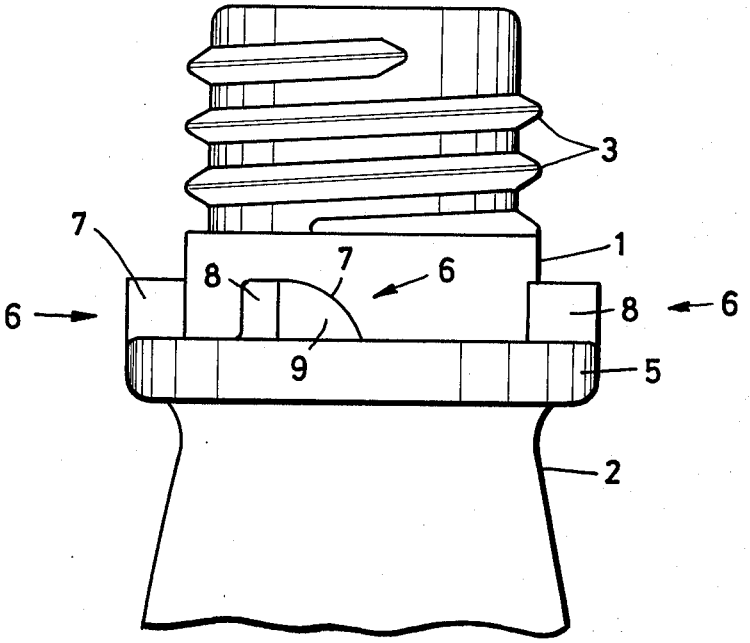
FIG. 2 is an elevational view of the upper portion of a bottle for the safety closure.

Referring now to the drawings more particularly to FIGS. 1-4, on the neck 1 of a bottle 2, a screw threading 3 is formed thereon, which threading 3 is provided for screwing on a screw cap 4. Moreover, on the neck of the bottle, a circumferential bead or ridge 5 if formed thereabout, on the upper side of which there are attached a plurality of teeth 6 which are staggered or offset with respect to one another in the peripheral direction.

Each tooth 6 is formed with a back 7 sloping risingly from the upper side of the bead 5 in the closing direction. Each tooth 6 also possesses a front 8 extending outwardly in the opening direction, which front 8 originates integrally from the neck of the bottle at an obtuse angle. Each tooth 6 also has a head 9, ending or closing on the outer side snug and flush with the bead 5.

Figure 3:
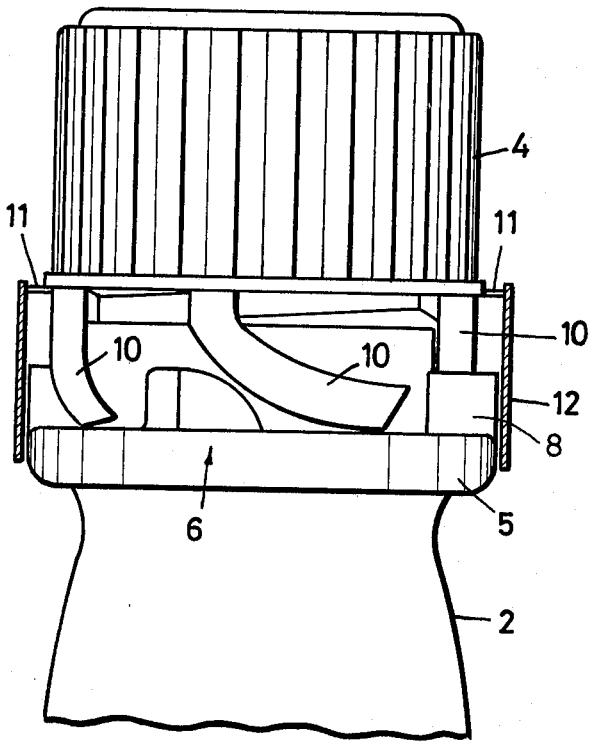
FIG. 3 is an elevational view of the upper portion of a bottle with a screwed on safety closure and partially cut out safety ring.
Figure 4:
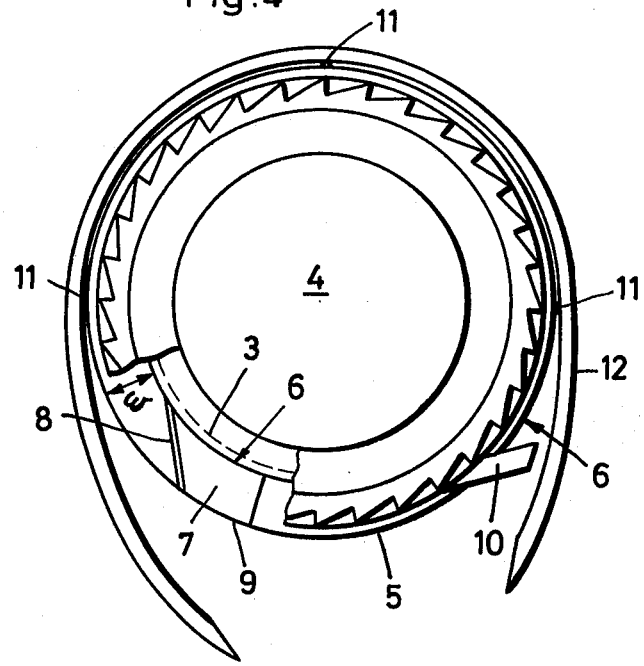
FIG. 4 is a top plan view of a safety closure with forced opened screw cap.

On the lower edge of the screw cap 4 attached thereto are a plurality of break-open pins 10 formed thinner than the radial width w of the bead 5, which pin 10 are staggered or offset with respect to one another about a peripheral angle or angle at circumference, the length of which pins corresponds approximately to the spacing of the teeth 6. During screwing of the screw cap 4 onto the threading 3, the break-open or rupture pins 10 are bent around on the backs 7 of the teeth 6 so that with the completely screwed cap 4 they lie in the spaces between the teeth 6 as illustrated in FIG. 3.

A safety ring 12 is connected with the screw cap 4 by means of a plurality of safety fracture stays 11. The ring 12 is formed so as to possess a continuous predetermined force limited safety breaking region 13 extending therethrough (note FIG. 1).

During the screwing off of the screw cap 4, the break-open pins are guided radially outwardly on the fronts 8 of the teeth 6 so that they press outwardly against the safety ring 12 and the latter is forced or broken open at the safety position area 13. The safety ring 12 can also be torn off from the remaining fracture safety stays 11 insofar as it has not been already released from the same during its splitting or bursting open.

Thereafter the screw cap 4 without the safety ring 12 remains fully functionable and can be used for repeated closing of the bottle 2. In this manner the break-open pins 10 provide an additional security against an unintentional release.

Figure 5:
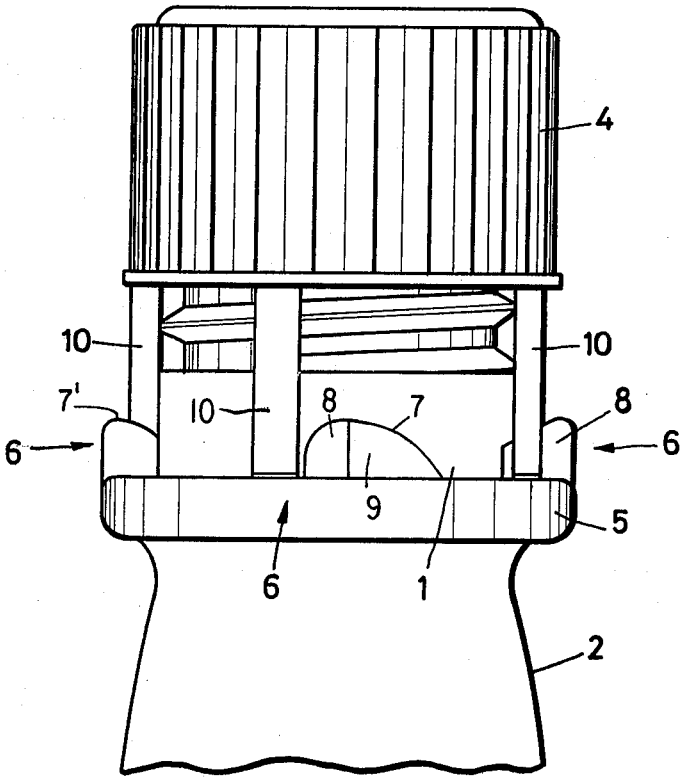
FIG. 5 is an upper elevational view of a bottle with a screw cap set thereon prior to screwing on without the safety ring.
Figure 6:
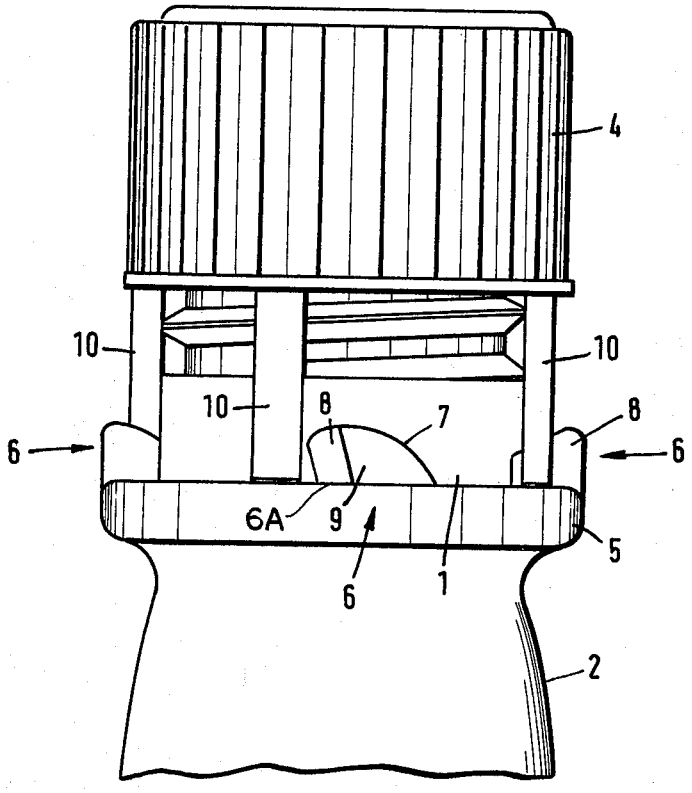
FIG. 6 is a view similar to FIG. 5 showing a front inclination on the teeth.

Referring now to the drawings and more particularly to the embodiment illustrated in FIG. 5, showing the cap loosely applied or set on the bottle, the teeth 6 are each formed with a back 7 which is additionally inclined in the closing direction by its tapered surface 7 from the outside toward the inside with respect to the neck 1 of the bottle 2, so that the break-open pins 10, during the screw-on fastening of the screw cap 4 on the bottle can be guided or brought inwardly toward and onto the neck 1 of the bottle 2, and are not then able to press outwardly against the safety ring 12 (not illustrated in FIG. 5). Also the front 8 of the teeth 6 can additionally be somewhat inclined from the base 6A thereof toward the back 7 so that the ends of the break-open pins 10 can be guided during the unscrewing for the first time as perpendicularly as much as possible from the inside to against the safety ring 12.

A safety closure formed in accordance with the present invention can be used practically for bottles of any order of size and for any purpose of use. Preferably ranges of use however are safety bottles for refreshment drinks, beer, spirits, liquor, medicines, and other chemical products.

While I have disclosed two embodiments of the present invention, it is to be understood these embodiments are given by example only and not in a limiting sense.

I claim:

1. A safety closure and bottle combination, said bottle having a thread on the neck and a bead arranged thereunder, including a screw cap adapted to be screwed on the thread on the neck of said bottle, a safety ring disposed around said screw cap, safety fracture stays breakably connecting said safety ring with said screw cap, at least two teeth arranged offset relative to one another by a circumferential angle on the bead, at least two break-open pins offset relative to one another by a circumferential angle, joined on a lower edge of said screw cap and adapted to operatively cooperate with said at least two teeth, said safety ring being formed with at least one safety breaking area, whereby upon screwing off said screw cap, said at least two break-open pins cooperate respectively with said at least two teeth and cause said safety ring to break at said safety breaking area.

2. The safety closure and bottle combination, as set forth in claim 1, wherein said at least two teeth each includes a back sloping upwardly from an upper side of the bead in a closing direction of said screw cap with respect to the bottle.

3. The safety closure and bottle combination, as set forth in claim 2, wherein said back of each of said at least two teeth is additionally inclined tapering from outwardly toward an inner direction to the neck of the bottle.

4. The safety closure and bottle combination, as set forth in claim 1, wherein said at least two teeth each includes a front extending outwardly substantially tangentially from the neck of the bottle in an opening direction of said screw cap from the neck.

5. The safety closure and bottle combination, as set forth in claim 1, wherein said at least two teeth each includes a front extending outwardly at an obtuse angle in an opening direction of said screw cap from the neck of the bottle.

6. The safety closure and bottle combination, as set forth in claim 5, wherein each of said at least two teeth includes a back facing in a direction opposite to a closing direction of said screw cap, said front of each of said at least two teeth additionally is inclined from a base thereof to said back.

7. The safety closure and bottle combination, as set forth in claim 1, wherein said at least two teeth each includes a head terminating outwardly flush with the bead.

8. The safety closure and bottle combination, as set forth in claim 1, wherein said at least two break-open pins are made of an elastically flexible material and lie in the longitudinal direction of the neck of the bottle with a loose condition of said screw cap set on the bottle.

9. The safety closure and bottle combination, as set forth in claim 1, wherein said at least two break-open pins are formed thinner than the radial width of the bead of 10. The safety closure and bottle combination, as set forth in claim 1, wherein said at least two teeth each have a back facing opposite a direction of closing of said screw cap, said at least two break-open pins are formed thinner than said backs of said at least two teeth are wide, respectively.

11. The safety closure and bottle combination, as set forth in claim 1, wherein said at least two teeth constitute a plurality of teeth greater than two spaced circumferentially around the bead of the bottle with spaces between said teeth, a plurality greater than two of said at least two break-open pins, in a closed screwed-on position of the screw cap on the bottle, lies in said spaces between said teeth, respectively.

12. The safety closure and bottle combination, as set forth in claim 11, wherein said teeth each have a front, said break-open pins have lower ends, respectively, said lower ends of said break-open pins point to said fronts of said teeth, respectively, said fronts lying adjacent in an opening direction relative thereto, respectively, in the screwed on position of the screw cap.

13. The safety closure and bottle combination, as set forth in claim 11, wherein the number of said teeth and said break-open pins as well as the circumferential angle therebetween are equal, respectively.

14. The safety closure and bottle combination, as set forth in claim 1, wherein said safety breaking area of said safety ring lies between two of said safety fracture stays and extends in a longitudinal direction of the neck of the bottle.

15. The safety closure and bottle combination, as set forth in claim 1, wherein said screw cap with said at least two break-open pins and said safety ring is made of a thermoplastic synthetic material.

* * * * *

UNITED STATES PATENT AND TRADEMARK OFFICE

CERTIFICATE OF CORRECTION

PATENT NO. : 4,081,097

DATED : March 28, 1978

INVENTOR(S) : Siegfried Dold, deceased

It is certified that error appears in the above-identified patent and that said Letters Patent are hereby corrected as shown below:

| | | |
|---|---|---|
| COLUMN 5, | line 16 (claim 9), | after "of" (second occurrence) insert the following: --the bottle.-- |
| COLUMN 1, | line 63, | "pin" should be --pins-- |
| COLUMN 3, | line 35, | "pin" should be --pins-- |

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*